US005704609A

United States Patent [19]

Mandel et al.

[11] Patent Number: 5,704,609

[45] Date of Patent: Jan. 6, 1998

[54] INTEGRATED INTER-MAILBOX MODULES BYPASS TRANSPORT AND PURGE TRAY SYSTEM

[75] Inventors: Barry P. Mandel; John D. Hower, Jr., both of Fairport; Charles D. Rizzolo, Rochester; Richard A. Van Dongen, Newark; L. James Rolph, Webster; William A. Novak, Rochester, all of N.Y.

[73] Assignee: Xerox Corporation, Stamford, Conn.

[21] Appl. No.: 568,725

[22] Filed: Dec. 7, 1995

[51] Int. Cl.[6] ..... B65H 39/10

[52] U.S. Cl. ..... 271/290; 271/298; 271/303

[58] Field of Search ..... 271/289, 290, 271/298, 303; 270/58.18, 58.14

[56] References Cited

U.S. PATENT DOCUMENTS

| | | | |
|---|---|---|---|
| 4,515,458 | 5/1985 | Masuda et al. | 271/289 X |
| 5,045,881 | 9/1991 | Kinder | 355/206 |
| 5,172,162 | 12/1992 | Taneda | 355/202 |
| 5,248,136 | 9/1993 | Hamanaka | 271/290 X |
| 5,295,181 | 3/1994 | Kuo . | |
| 5,342,034 | 8/1994 | Mandel et al. | 270/53 |
| 5,358,238 | 10/1994 | Mandel et al. | 271/298 |
| 5,370,384 | 12/1994 | Romanowski | 271/297 |
| 5,382,012 | 1/1995 | Mandel et al. | 270/53 |

*Primary Examiner*—David H. Bollinger

[57] ABSTRACT

A plural function sheet interconnect module for serially connecting plural multiple bins printed sheets job separating units, such as mailbox modules, with the output of a printer for feeding printed sheets jobs into selected bins. The printer also has a alternate variably occurring output of purge sheets designated for purging, which purge sheets are variably intermixed with the printed sheets jobs. The interconnect module has a sheet bypass transport for feeding the sheets on from one mailbox unit on to another. The interconnect module also has an integral purge tray for collecting the purge sheets and providing for their removal. The interconnect module further has a selectable shared sheet gating system for gating the printed sheets jobs into the sheet bypass transport and gating the purge sheets into the integral purge tray. The integral purge tray underlies the sheet bypass transport and is pivotably openable for the removal of purge sheets therefrom.

8 Claims, 3 Drawing Sheets

INTEGRATED INTER-MAILBOX MODULES BYPASS TRANSPORT AND PURGE TRAY SYSTEM

There is disclosed in the embodiment herein a plural mode system and multipurpose module for providing, with a reduced number of parts and costs, in the same multifunction module, a purge tray for purging undesired purge sheets from a printer and/or a sidetrack tray for retaining desired copy sheets when downstream jams occur, integral to a printed sheets bypass transport for normally transporting printed sheets from one multi-bin sheet stacking module (especially, a mailbox unit) to another to increase the number of available sheet stacking bins, especially, to link several multi-bin units together. This multifunction module may also provide the physical docking interconnection between such cascaded plural mailbox modules.

As is disclosed in the reference below, this compact integral multipurpose module can be inserted in a mailbox unit by removing one or two of its regular sheet stacking bins and inserting this multipurpose module in its place, so as to receive and be fed sheets therein by the same mailbox unit sheet feeding system as for the replaced sheet stacking bin(s), as if it were one. Thus, this hardware need not be built into the mailbox units, only inserted if needed.

Figure 1:
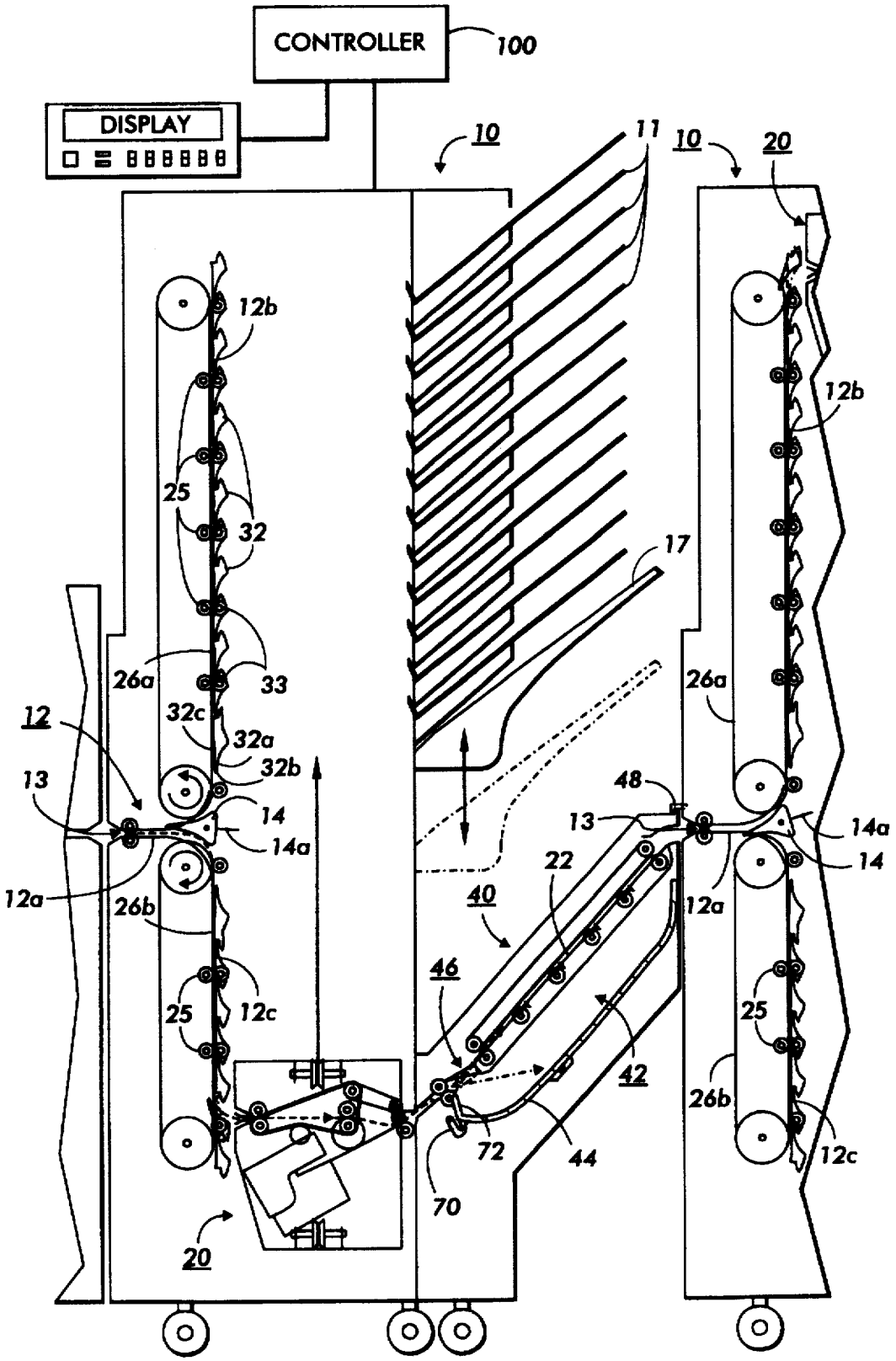

Of particular interest to the invention claimed herein is the prior partial disclosure of certain limited aspects thereof by several of these same inventors in their prior Xerox Corp. U.S. Pat. No. 5,382,012 filed Dec. 6, 1993 and issued Jan. 17, 1995, attorney docket no. D/92332Qi (together with other inventors, since different subject matter was also being claimed in that patent). In particular, the disclosed (and dependently claimed in claims 7–9) insertable bypass transport for transporting sheets in between printer mailbox units 10 is described therein as follows. The first paragraph of Col. 7 of this U.S. Pat. No. 5,382,012, states: "As also shown, an optional bypass transport 22, as in FIG. 1, can be substituted and used in the location of two adjacent bins 11, preferably the two bins closest to the output end of central sheet path 12*a*. This bypass 22 passes sheets centrally on to another unit 10 or other finishing module with conventional roller or belt feeders." Also, the further description in Col. 8 lines 23–34 of this U.S. Pat. No. 5,382,012 states: "Referring further to the optional bypass transport 22, this provides a short and central bypass extension path through a module 10 on to the central entrance 13 of another module 10. It can be provided simply by removing two adjacent bins in an area adjacent the center of the bin array and mounting into that space a removable simple sheet transport, such as that illustrated, which extends out centrally through and slightly beyond the outer ends of the array of bins, to provide an optional sheet output centrally on the side of the module 10 opposite the entrance 13 side of the module 10, as shown in FIG. 1." As further stated in Col. 7, line 65 through Col. 8 line 6: "As noted, the disclosed unit 10 is desirably a universal stand-alone unit that is attached to, or even simply moved next to, the output of almost any conventional printer. Plural units 10 may be ganged in series, like plural sorters, if desired, as shown in FIG. 1, for an increased number of available bins, using conventional sheet pass-through feeders and gates and/or the bypass 22 shown herein, or the like. As is well known in sorting, sorter bin units can be extended or serially connected in this manner to provide more available bins."

The same schematic view of a bypass 22 between two similar mailbox units 20 is shown in FIG. 1 of Xerox Corp. U.S. Pat. No. 5,370,384 issued Dec. 6, 1994 to Robert F. Romanowski (sole), filed Feb. 8, 1994, but is not described there other than so identifying it in Col. 7 lines 31 and 58.

As indicated, with conventional sorters it is well know to provide a printed sheets bypass transport for transporting printed sheets from one multibin sheet stacking module to another to increase the number of available sheet stacking bins, and this can be referred to as "ganging" the plural sorter units. This is taught in patents cited in said U.S. Pat. No. 5,382,012, and other patents.

As to purging systems, of particular interest is Fuji Xerox Corp. U.S. Pat. No. 5,172,162 issued Dec. 15, 1992 to Kengo Taneda. Disclosed therein is an interposed intermediate transfer unit, transporting sheets between an image recording device such as a printer and an external sheet processor such as a sorter, which has a purge tray in this intermediate transfer unit.

Further by way of background as to purging systems and purging trays, and the need for same in a reproduction system, this is well known in general from the patent literature, and accordingly, it is not necessary to repeat that in detail herein. Purging only defective sheets which need to be removed from a print job is much more efficient and environmentally sound than discarding entire completed or incomplete job sets. Furthermore, for improved productivity in reproduction apparatus, it is desirable for the machine controller to automatically initiate purging of certain sheets when the controller becomes aware from its inputs and sensors within the paper path and the job input that there are sheets in the paper path of the reproduction apparatus which have not been correctly imaged, or are in the wrong order, or, due to jams, should be cleared out of the machine to eliminate or reduce tedious operator manual removal of sheets in the paper path of the reproduction apparatus. By automatically purging misprinted or other purge sheets, it is possible to properly reprint the purged sheets and continue the printing operation with minimized printing interruption or down time. However, it is also desirable to avoid the expense and space of a separate tray and its paper path just for purged sheets. Yet, it is very undesirable to intermix these defective or out of order purge sheets with properly printed sheets, particularly if they are going into a finisher to be bound into sets, since such bound sets or books with defective or out of order sheets would have to be entirely rejected. In the presently disclosed system, printing may continue during and after a purge of defective sheets (e.g., purging sheets printed out of order or with defective images, or located downstream of a jam site).

Particularly noted by way of background as to purging systems is Xerox Corporation U.S. Pat. No. 5,045,881 issued Sep. 3, 1991 to Carla J. Kinder, et al, entitled "System for Segregating Purged Sheets and Continued Printing", and art cited therein.

It is also known that when plural sorter units are ganged together in series to increase total bins availability, that a jam in any one of the downstream bins or bin array units of sheets destined for a further downstream bin can cause stoppage of paper feeding in the entire upstream chain of sorter units and bypass transports therebetween. This can also result in a complete printing stoppage or even a requirement to manually clear out the entire paper path, unless a purge or "sidetrack" tray is provided for those sheets upstream of the jam site or location. In ganged sorters it is known to use the open top tray of one of the sorter modules as a purge tray, and to gate purge sheets thereinto.

Disclosed in the embodiment herein is an improved plural unit "mailboxing" interconnection system with additional functions. As to the function and purpose and operation of such exemplary mailbox units per se, and mailboxing systems in general, this is taught in detail in said above cited U.S. Pat. No. 5,382,012 and other Xerox Corp. U.S. patents such as U.S. Pat. Nos. 5,342,034 or 5,358,238 and 5,295,181, and extensive references cited therein, and thus need not be discussed in detail herein. Such mailbox units can automatically discretely handle and segregate received print job sheets from a shared remote printer, copier, scanner, facsimile, multi-mode or other such printer outputs. The disclosed mailbox units can each desirably be a universal modular or stand-alone unit. One such mailbox unit may be attached to, or even simply moved next to, the output of almost any conventional copier or printer, including facsimile machines or networked electronic mail printers, to normally receive its output of printed sheets. Here, it may also receive and handle purge sheets. Here also, one or more additional mailbox units may be moved next to a prior such mailbox unit to add additional bins capacity.

Although plural mailbox unit chaining expansion capability is highly desirable, it is not desirable to have to increase the unit manufacturing cost of each mailbox unit by requiring each mailbox unit to contain extra hardware for inter-unit chaining sheet transports, whether utilized or not, or to sacrifice bin space to do so. The disclosed system does not. No additional drives or paper paths need be designed into the base mailbox unit.

Printer mailbox systems do not operate like sorters. They provide an assignable or selected discrete bin or bins for designated users, for all of the printed sheets for a designated user (or shared users), enabling a user's print jobs or other output to be directed into a selected bin so assigned. Preferably, the user's mailbox output is plural, pre-collated, print jobs, with all sheets going to a single bin if it has adequate sheet stacking space, not requiring collation or sorting. Thus, job or addressee "mailboxing" is not "sorting" in the common or usual sense of a collating plural identical copy sheets by sequentially placing each such sheet in a different bin, and repeating those steps. However, similar "sorter" hardware may be employed in part if it can provide rapid random bin access and other desired features.

To express it in another way, a "mailbox" in the example herein takes multiple print jobs from a printer (from user terminals, fax, networked page images, scanned document jobs, or the like, or combinations thereof) and separates the print jobs by users and stacks these hardcopy outputted print jobs into individual bins for individual users, by users. As an additional software option, users may also send print jobs to other users' mailbox bins if desired. Mailbox bins can, in general, be either user assignable, or automatically assigned by the printer, print server, or mailbox unit. Optionally, jobs can be individually stapled or otherwise finished if a stapler or other set binding unit is provided. Optional privacy or security doors with locks can be added to any or all bins if desired. An overflow bin and/or general, shared, stacking tray may also desirably be provided, not assigned to any one user.

A specific feature of the specific embodiment disclosed herein is to provide a plural function sheet interconnect module for operatively connecting between plural multiple bins printed sheets job separating units serially connecting with the output of a printer which is outputting printed sheets jobs for feeding into selected said bins, wherein said printer also has an alternate variably occurring output of purge sheets designated for purging, which purge sheets are variably intermixed with said printed sheets jobs, said interconnect module having a sheet bypass transport for feeding said printed sheets jobs from one said multiple bins job separating unit on to another said multiple bins job separating unit, said interconnect module further having an integral purge tray for collecting said purge sheets therein, said purge tray providing for removal of said purge sheets therefrom, and said interconnect module further having a selectable shared sheet gating system for selectably gating said printed sheets jobs into said sheet bypass transport and selectably gating said purge sheets designated for purging into said integral purge tray.

Further specific features disclosed in the embodiment herein, individually or in combination, include those wherein said integral purge tray underlies said sheet bypass transport and is pivotably openable for said removal of purge sheets therefrom; and/or wherein at least one of said said multiple bins of said multiple bins job separating unit is removable, and wherein one end of said said plural function sheet interconnect module is mountable into a said multiple bins job separating unit in place of at least one of said removable bins; and/or wherein said multiple bins job separating unit is a standardized module for the collection, separation and stacking of printed sheets received from the output of said printer, comprising multiple sheet collection bins in a vertical array, a sheet input for receiving the printed sheets from the output of printer, and an internal sheet transport path for transporting the printed sheets from said sheet input to a selected said bin, and a bin selector system for directing selected sheets into a selected said bin; which standardized module multiple bins job separating unit does not have a said sheet bypass transport for feeding said printed sheets jobs from one said multiple bins job separating unit to another; and/or wherein one end thereof is adapted to mount into a said multiple bins job separating unit, to extend therefrom, and the other end thereof has a docking system for docking with another said multiple bins job separating unit; and/or wherein said sheet transport bypass path extends with an upward inclination between multiple bins job separating units, and said integral purge tray is similarly upwardly inclined; and/or wherein said integral purge tray underlies said sheet bypass transport and is pivotably openable for said removal of purge sheets therefrom; and/or wherein said shared sheet gating system automatically deactivates said sheet bypass transport upon said selective gating of said purge sheets into said integral purge tray.

As to usable specific or alternative hardware components of the subject apparatus, it will be appreciated that, as is normally the case, some such specific hardware components are known per se in other apparatus or applications. For example, various commercially available modular sorter units are known for sorting the output of xerographic copiers or other printers, with various hardware systems. Examples include above-cited art and its references.

The presently disclosed apparatus may be readily operated and controlled in a conventional manner with conventional control systems. It is well known in general and preferable to program and execute such control functions and logic with conventional software instructions for conventional microprocessors, with operator input selections, paper path sensor inputs for sheet locations and jams, and output control signals to actuate paper path controlling drives, clutches, solenoids, gates, etc., as is well known and taught by various patents and various commercial copiers, printers, and sorters. Such software may of course vary considerably depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hardwired logic or switching systems.

All references cited in this specification, and their references, are incorporated by reference herein where appropriate for appropriate teachings of additional or alternative details, features, and/or technical background.

Figure 2:
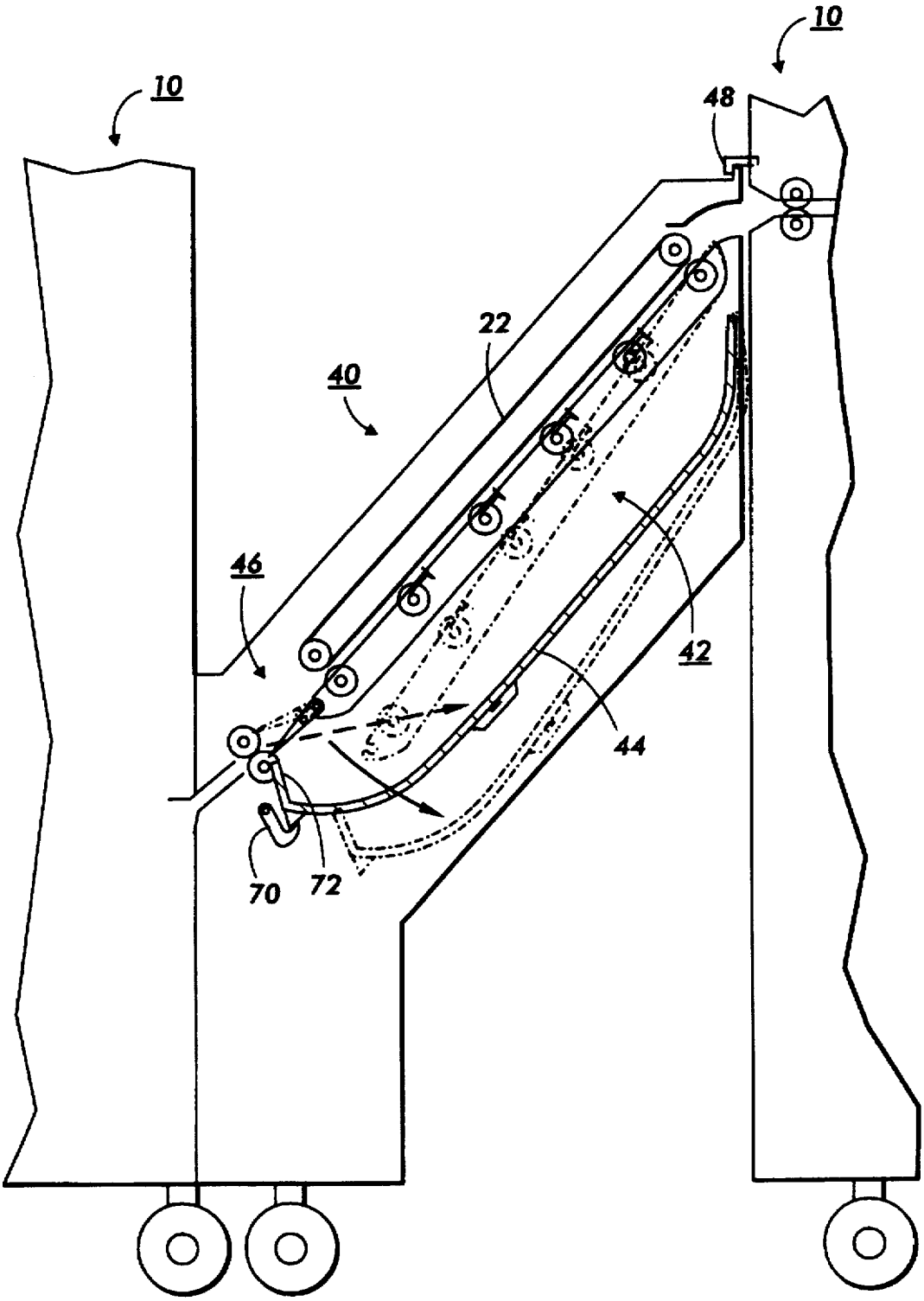
Figure 3:
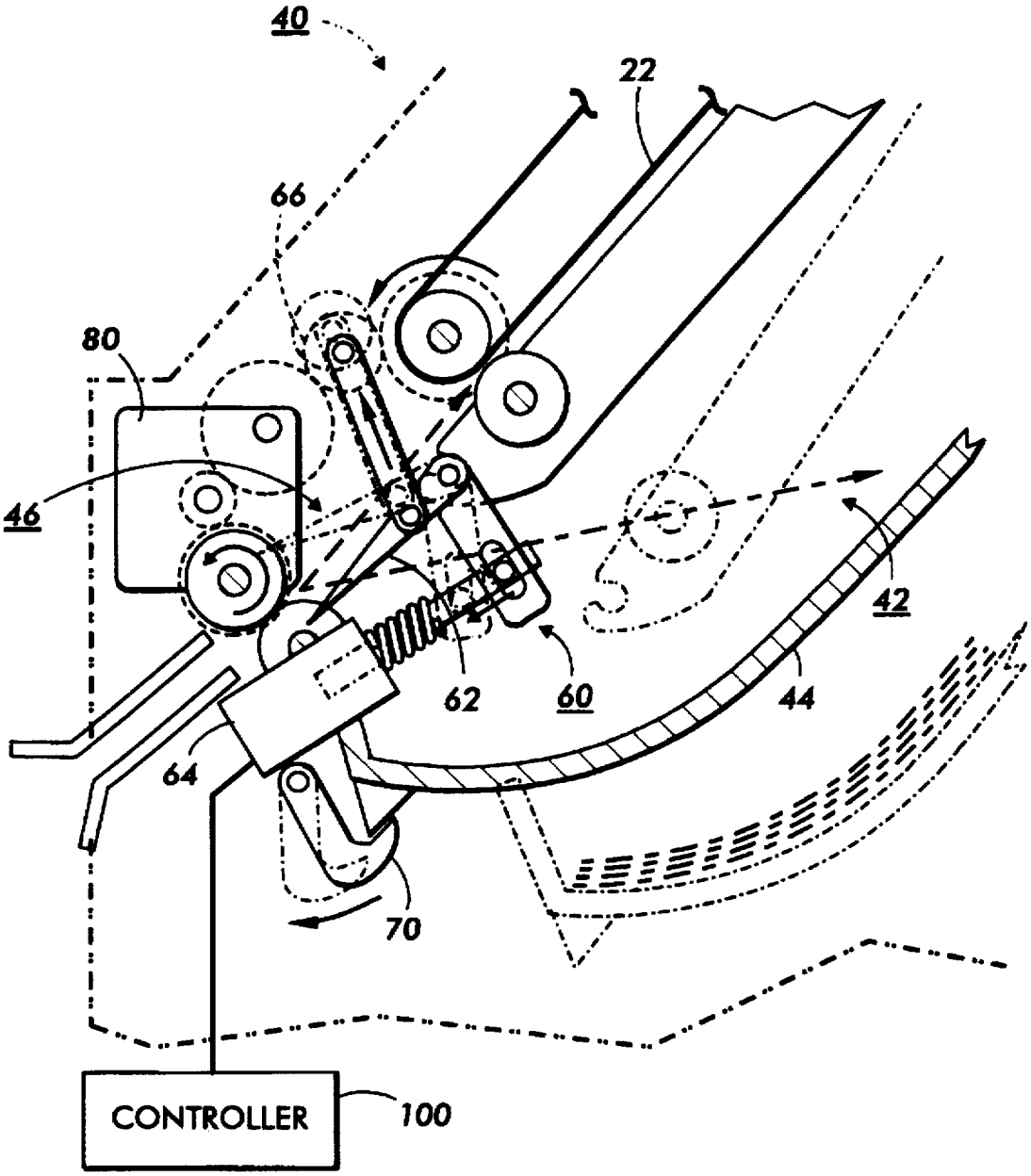

Various of the above-mentioned and further features and advantages will be apparent from the specific apparatus and its operation described in the example below, as well as the claims. Thus, the present invention will be better understood from this description of one embodiment thereof, including the drawing figures (approximately to scale) wherein:

FIG. 1 is a schematic frontal view, partially in cross-section, of one embodiment of a mailbox/finisher/stacker unit incorporating the subject insertable multfunction module with an integral purging and purge tray system and an integral interconnect sheet transport, showing a second such mailbox unit connecting in series therewith via said multifunction interconnect module, and also showing the output portion of a printer input to the first mailbox unit;

FIG. 2 is an enlarged view of a portion of FIG. 1, of the first mailbox unit portion containing said multifunction interconnect module better illustrating its exemplary integral purge sheet path and purge tray; and FIG. 3 is a a further enlarged and schematic view of a portion of FIG. 2 showing an exemplary simple switchable shared sheet drive and gating system for selectably feeding print job sheets either to said interconnect sheet transport or to the purge or sidetrack tray of said multifunction interconnect module.

Disclosed in these FIGS. is an insertable and removable multipurpose interconnect module 40, which can operatively and physically link several mailbox units 10 together, and also provide an accessible and lower cost purging and sidetrack system 42. The disclosed multifunction module 40 combines features of a paper bypass or interconnect transport 22 connectable between two ganged mailbox units 100 plus an integral purge tray 44, a sheet diverter system 46, and a docking lock 48. This module 40 is insertable in the upstream mailbox by removing one or two of its bin(s) 11, here its bottom bins(s) 11.

In operation, the controller 100 directs sheets in the mailbox unit 10 internal paper path to the sheet input gate for the removed bin as if that bin were still present in that mailbox unit, and they now enter the module 40 input (upstream end) now located there instead. The other (downstream) end of the module 40 can be attached by a conventional docking latch or lock 48 thereon, or other conventional docking system, engaging appropriate simple docking hardware at the sheet input of the next (downstream) mailbox unit. The interconnect sheet transport 22 has conventional sheet path belts and/or rollers to transport the sheets from the upstream printer passing through the first mailbox unit on to the next mailbox unit via this connection. Further ganged mailboxes can be similarly added, by similarly adding further such modules 40 to feed paper from one mailbox on to the next with their interconnect sheet transports 22.

As additionally provided here, the integral purge tray 44 of each interconnect module 40 additionally alternatively provides for capturing and retaining for removal of selected said sheets from the upstream printer, whenever the integral sheet diverter system 46 so directs. The integral purge tray 44 also provides a location to sidetrack copies when a jam is detected downstream in any downstream mailbox or interconnect module. Unlike defective or out of order purge copies from the printer, these sidetracked sheets may be retained and refed or hand inserted later in downstream bins, if desired.

This system is preferable to other designs with top bypass transports, and also allows for particular ease of jam clearance. It may be seen, especially in FIG. 2, that the tray 44 here is located compactly under and generally parallel to the interconnect sheet transport 22. Because the sheet transport 22 here is inclined uphill, the tray 44 can be likewise inclined uphill, and desirably provides uphill stacking to gently stop purged or sidetracked sheets in the tray 44. A tray latch 70 is shown here engaging the front of the tray 44. When the latch 70 is unlatched, the tray 44 can pivot open for ease of sheet removal therefrom, yet the upstanding front registration edge wall 72 of tray 44 prevents the sheets from sliding out.

As particularly shown in FIG. 3, additional parts and cost savings, as well as accurate sheet velocity, can be provided as in this example by driving the inter-mailbox unit 40 transport 22 sheet drives (via a mechanism 60 described below) with the same servo motor drive 80 normally used to move the finishing carriage 22 up and down. This can be done here because that servo motor drive 80 is not in use for the finishing carriage 22 drive during use of the unit 40 since the finishing carriage 22 is then "parked" at the bin location now providing sheet entrance to the unit 40, rather than moving between different bins 11. Alternatively, the same controller electronics can be used to drive another stepper motor.

As additionally shown in FIG. 3, considerable parts and cost reduction can be provided as opposed to separate purge trays and their feed paths. Here, the sheet diverter system 46 comprises a mechanism 60 controlling a sheet diverter gate 62 actuated by a single solenoid 64. When the solenoid 64 is not actuated, the mechanism 60 pivots the diverter gate 62 out of the sheet entrance path to module 40. That allows paper to proceed normally into and through the bypass transport 22. However, when the solenoid 64 is actuated by a signal from the controller 100, the mechanism 60 pivots the diverter gate 62 into this sheet path to divert sheet down into the purge tray 44, e.g., in response to a signal when, or slightly after, a jam occurs, timed to capture the arrival at that gate of the sheets to be purged. Here, this same solenoid 64 driven mechanism 60 also disables the sheet drive to the bypass transport 22 during such a purging operation, by moving a gear 66 out of its gear train drive path, as shown in phantom in FIG. 3, to prevent sheets from moving beyond that point. This drive disconnect could, of course, also be done by opening a feed roll nip, or clutch.

Turning now to the exemplary embodiment 10 of an multi-bin mailbox unit shown in the FIGS., it will be appreciated that this is merely one example thereof, and for exemplary purposes is the unit 10 shown in the above-cited U.S. Pat. No. 5,382,012, which may be referred to for further details. The general reference number 10 is utilized here for the entire output unit or module. Likewise, the general reference number 11 will be used throughout for any individual mailbox (or sorter) tray or bin. The printer to which the mailbox system may be operatively connected is only partially shown, for its output at the left side of FIG. 1, since various printers may be so connected to this unit 10, with little or no printer modifications. The illustrated mailbox bins, compiler/stapler, etc., illustrated or described herein are also exemplary, and may individually vary considerably.

The specific example 10 illustrated is a mailbox/finisher/stacker module or unit 10 with a sheet path 12 fed sheets (entered) at a central or intermediate sheet entrance 13 at one side thereof. The sheets are fed into a common path portion 12*a*, and then into one of two split path vertical sheet transports 12*b* or 12*c* respectively branching up or down, as selected by a gate 14. This central sheet path deflector gate 14 may be switched or actuated here into either an up or down position simply by the motion of a finishing carriage 20. Although an exemplary finisher unit or carriage 20 is shown here, it is not required, and similar advantages can be provided in a non-finishing sorter or mailbox module. The module 10 here also includes a high capacity elevator stacking tray 17. The gate 14 is automatically moved into the correct position to direct sheets to either the upper or lower vertical sheet transport paths 12*a* or 12*b* by the vertical motion (impact) of the finishing carriage 20 via an extension 14*a* of the gate 14 extending into its path, as shown.

For "mailboxing" functions, the conventionally sequentially received hard copy of plural page collated documents from a preocollation output electronic printer or the like may be fed into the mailbox unit 10 and automatically fed to the particular bin 11 assignment destination of those job sheets. The mailbox unit 10 preferably directs all designated sheets of a users job to an available bin or bins 11 temporarily assigned to that printer user based on bin availability, or directs the sheets on to another bin 11 in another downstream mailbox unit 10 via the module 40. A variable display (FIG. 1) connected to controller 100 may indicate the bin(s) 11 into which that particular user's jobs have been placed last and not yet removed. These may be plural pre-compiled and/or pre-stapled job sets stacked in a selected user bin, as provided by the compiler/finisher unit 20.

The mailbox job sorting unit 10 can take sheets inputted at its sheet input 13 from various printer outputs, including multi-functional units. The input 13 may, if desired, be provided with a pivotal or otherwise vertically adjustable input ramp and/or feeder, which may be in an interface module, to align with various levels of printer outputs. Since the output of the printer may be acquired sequentially as individual unstacked sheets as it outputs, no sheet separator is required for the unit 10, and thus a very simple input feeder can be used. It can even be positioned or adapted to reach into the pre-existing sheet output tray of the printer to pull the sheets out of that tray. The unit 10 input preferably has a conventional sheet input sensor actuated by sensing the entrance of a sheet lead edge into its sheet entrance path 12*a*.

The internal sheet feeding path 12 in the mailbox unit 10 can utilize various known sorter sheet transports, many of which are shown in cited art and other art, providing the sheet path and advantages discussed above are provided. Here, in this example, once each output sheet of the printer has been acquired by the input feeder or the like of the initial common path 12*a* of the unit 10, the further sheet feeding may be done in path 12*b* or 12*c* by the illustrated rollers 25 engaging respective sets of belts 26*a* or 26*b* to form feed nips feeding the sheet along the belts 26 until the sheet meets a bin selection and feeding means 30 which, when activated, deflects the sheet into that selected bin 11. Here the inside flight or bight of the two sets of moving belts 26*a* and 26*b* respectively carries the sheet thereon upwardly in path 12*b* (or downwardly in path 12*c*) from the center of the unit 10 past a respective series of gates or sheet deflectors 32. The sheet is deflected 11 by a curved surface 32*a* of the gate 32 for a selected bin 11 when the sheet reaches an opened gate 32 adjacent the selected bin or tray 11. Where a finisher carriage such as 20 here is provided, the sheet is deflected into that units paper path, which then transports the sheet through the carriage 20 to the appropriate, adjacent, bin.

As noted, various components of the mailbox unit 10 can be conventional, even commercially available, except as controlled and modified as described herein. Various feeding and gating arrangements whereby inputted sheets are fed to and gated into selected bins by a moving gate with a positionable sheet deflector, rather than by separate associated deflecting bin gates, as here, are well known in the art. The illustrated moving frictional belts 26 transport system and the plural stationary but pivotal sheet deflectors 32 to selectably deflect sheets from the feed belts 26 into the selected bin 11 are merely exemplary.

As noted, the entire operation of the exemplary mailbox module unit 10 here may be controlled by an integral conventional low cost microprocessor controller 100, conventionally programmable with software for the operations described herein. Such a system has more than ample capability and flexibility for the functions described herein, and also for various other functions if desired, such as jam detection and jam clearance instructions.

Optionally, one bin or tray 11 of the unit 10 may (conventionally) provide an open general use tray or bin. The top bin of a sorter is often so used for undesignated or unknown users jobs, jam purges, overcapacity jobs too large for regular bins, etc., since it is not limited in stack height by any overlying tray. Here, the high capacity stacking tray 17 may be the default or public output. Such a designated general use tray may alternatively be the tray or bin 11 located just below the tray 17 output location, where it may be fed sheets via the uppermost or top gate 32 on the lower vertical belt transport 12*c*. Since all users may have to access a general use tray, this central location ensures that all users can reach it easily. Where that tray is to be so designated, then the two trays 11 to be removed for the bypass module 22 are preferably the next two trays below that. I.e. slightly varying from FIG. 1, there would be this one dedicated general use tray 11 above the bypass module 22. Note however that here the high capacity stacking tray 17 is also available for automatic switchover of the printer output to this tray 17 by controller 100 for such modes. The unit 10 may, if desired, also be flexibly modifiable into different size, capacity or spacing tray/bin configurations.

Examples of systems for variably mounting shelves and/or movable sheet stacking trays to the same frame unit are shown, for example, in the above-cited Mandel et al. U.S. Pat. No. 5,098,074, and in U.S. Pat. No. 3,907,279. Other such variable shelf mounting systems are well known e.g., for wall mounting racks or bookshelves, such as a fixed vertically slotted track into which the "J" shaped ends of bookshelf or rack supports are cantilever mounted.

In the illustrated mailbox unit 10 internal sheet diversion system 30 example here, as further described in the above cited patents, plural sheet diverter gates 32 are commonly mounted in line on rotatable shafts 33 to define plural gate units 34. The number and spacing of such gates/shaft units 34 equals the number and spacing of the bins 11. They are closely parallel to, and vertically spaced along, the plural belts 26 sheet transport. The same shafts 33 may also support the sheet path idler rollers 25 forming the sheet feeding nips with that side of the belts 26, as shown. However, instead of being conventionally directly adjacent the bins, (as they could be) in this example the diverter gate units 34 here are horizontally separated from the bins here by the space for (width of) the vertically moving finishing carriage 20, here comprising compiler/stapling unit 90. When one set or unit 34 of the pivotal gates 32 is pivoted, the top surface 32*a*, including end fingers 32b of each gate 32, acts as sheet deflectors to deflect sheets off of the sheet transport belts 26 at that gate unit 34 location, and into (or through) the adjacent compiler finishing carriage unit 20 which is located at that selected bin 11 location. The selected single line of gates 32 (one gate unit 34) may be pivoted on shaft 33 by direct mechanical engagement of a cam actuator 35 on the elevator/compiler unit 20 with a gate opening cam follower 36 on the pivotal gate unit 34 shaft 33. This pivots said end fingers 32b of that set of gates 32 out through spaces between or on each side of the vertical sheet transport belt(s) 26 so that these fingers 32b are positioned to catch the sheets on their top surface 32a and deflect them off of the belt transport and into the compiler unit. Meanwhile, all the other pivotal gates 32 are all spring (or gravity) loaded into a closed (vertical) position, in which their rear or left sides 32c function as sheet guides or baffles to maintain sheets on the transport belts 26 vertical path passing thereby.

When the pulley/cable or other elevator system driven by servo motor 80 moves the compiler finishing carriage unit 20 on to a different selected bin position, the previously opened adjacent bin gates re-close, and that other newly selected set of 34 gates 32 is pivoted open. This eliminates the requirement for multiple solenoids, one for each bin, and their wiring for bin selections. That is, here there are plural, but dual mode, gates, which are individually cammed open one at a time by a moving compiler/finisher unit, which also forms part of the sheet path into the selected bin. Thus, this finishing carriage unit 20 here actuates, and forms part of the sheet diversion and bin selection system 30.

Note that moving gate sorters (e.g., Norfin Co. Snelling, et al. U.S. Pat. No. 3,414,254) are known in the sorter art. However, typically these have only a single non-pivotal gate, per se, having one set of non-pivotal deflector fingers between the bins and the belt and/or vacuum sheet transport, always extending into the belts, which single gate is moved up and down past the bins by an elevator mechanism. In contrast, here the compiler unit 90 is vertically moved up or down to its adjacent bin, not the gates. Various known elevator systems may be used for the compiler/stapler unit 20 here, such as elongated screw shafts rotated by a motor at their top or bottom, or a driven cable belt and pulley system. The unit 20 can conventionally slide up and down on conventional vertical elevator rails or smooth cylindrical rods. This example here of a sheet job set compiling and stapling and/or ejecting system may be, for example, similar to that disclosed and described in the above and other patent literature including U.S. Pat. No. 5,098,074.

Thus, there is disclosed integral the unit 10 here a single repositionable compact compiling/stapling unit 20 for stacking, registering and attaching sets of printing machine output and ejecting it fully into its them adjacent and thus selected bin 11. In this example, this same compiler/finisher unit 20 may also be positioned to similarly feed sheets or sets of sheets on top of a stack of sheets in the stacking tray 17. However, this is a plural mode operating system, which can also function as a single sheet pass-through feeder, feeding sheets directly sequentially into the bin 11 to stack therein, or on to a bypass transport such as 22 to pass sheets sequentially on to another module 10.

While the embodiment disclosed herein is preferred, it will be appreciated from this teaching that various alternatives, modifications, variations or improvements therein may be made by those skilled in the art, which are intended to be encompassed by the following claims:

What is claimed is:

1. A plural function sheet interconnect module for operatively connecting between plural multiple bins printed sheets job separating units serially connecting with the output of a printer which is outputting printed sheets jobs for feeding into selected said bins, wherein said printer also has an alternate variably occurring output of purge sheets designated for purging, which purge sheets are variably intermixed with said printed sheets jobs, said interconnect module having a sheet bypass transport for feeding said printed sheets jobs from one said multiple bins job separating unit on to another said multiple bins job separating unit, said interconnect module further having an integral purge tray for collecting said purge sheets therein, said purge tray providing for removal of said purge sheets therefrom, and said interconnect module further having a selectable shared sheet gating system for selectably gating said printed sheets jobs into said sheet bypass transport and selectably gating said purge sheets designated for purging into said integral purge tray.

2. The plural function sheet interconnect module of claim 1 wherein said integral purge tray underlies said sheet bypass transport and is pivotably openable for said removal of purge sheets therefrom.

3. The plural function sheet interconnect module of claim 1 wherein at least one of said said multiple bins of said multiple bins job separating unit is removable, and wherein one end of said said plural function sheet interconnect module is mountable into a said multiple bins job separating unit in place of at least one of said removable bins.

4. The plural function sheet interconnect module of claim 1 wherein said multiple bins job separating unit is a standardized module for the collection, separation and stacking of printed sheets received from the output of said printer, comprising multiple sheet collection bins in a vertical array, a sheet input for receiving the printed sheets from the output of printer, and an internal sheet transport path for transporting the printed sheets from said sheet input to a selected said bin, and a bin selector system for directing selected sheets into a selected said bin; which standardized module multiple bins job separating unit does not have a said sheet bypass transport for feeding said printed sheets jobs from one said multiple bins job separating unit to another.

5. The plural function sheet interconnect module of claim 1 wherein one end thereof is adapted to mount into a said multiple bins job separating unit, to extend therefrom, and the other end thereof has a docking system for docking with another said multiple bins job separating unit.

6. The plural function sheet interconnect module of claim 1 wherein said sheet transport bypass path extends with an upward inclination between multiple bins job separating units, and said integral purge tray is similarly upwardly inclined.

7. The plural function sheet interconnect module of claim 6 wherein said integral purge tray underlies said sheet bypass transport and is pivotably openable for said removal of purge sheets therefrom.

8. The plural function sheet interconnect module of claim 1 wherein said shared sheet gating system automatically deactivates said sheet bypass transport upon said selective gating of said purge sheets into said integral purge tray.

* * * * *